US010604300B2

(12) United States Patent
Eckert et al.

(10) Patent No.: US 10,604,300 B2
(45) Date of Patent: Mar. 31, 2020

(54) CONTAINER SYSTEM

(71) Applicants: Elliott Eckert, Belmont, MI (US); Joseph D. Rotonda, Grand Haven, MI (US)

(72) Inventors: Elliott Eckert, Belmont, MI (US); Joseph D. Rotonda, Grand Haven, MI (US)

(73) Assignee: Evolve Packaging Solutions LLC, Belmont, MI (US)

( * ) Notice: Subject to any disclaimer, the term of this patent is extended or adjusted under 35 U.S.C. 154(b) by 112 days.

(21) Appl. No.: 15/590,640

(22) Filed: May 9, 2017

(65) Prior Publication Data

US 2017/0320625 A1 Nov. 9, 2017

Related U.S. Application Data

(60) Provisional application No. 62/333,510, filed on May 9, 2016.

(51) Int. Cl.

| | |
|---|---|
| ***B65D 6/18*** | (2006.01) |
| ***B65D 8/00*** | (2006.01) |
| ***B65D 6/24*** | (2006.01) |
| ***B65D 21/02*** | (2006.01) |

(52) U.S. Cl.
CPC ..... *B65D 21/0219* (2013.01); *B65D 11/1846* (2013.01); *B65D 11/1866* (2013.01); *B65D 15/22* (2013.01)

(58) Field of Classification Search
CPC ..... B65D 11/1846; B65D 11/1866; B65D 11/1893; B65D 15/08; B65D 15/22; B65D 15/24; B65D 19/385; B65D 21/0219; B65D 5/006
See application file for complete search history.

(56) References Cited

U.S. PATENT DOCUMENTS 2,941,710 A * 6/1960 Smith ..... B65D 7/28 217/12 R
4,241,864 A * 12/1980 Kessler ..... B65D 15/08 215/233
4,483,444 A * 11/1984 Gardner ..... B65D 81/05 206/320
5,265,797 A * 11/1993 Velge ..... B65D 5/4283 229/125.26
5,678,717 A * 10/1997 Hsu ..... D06F 95/002 220/4.28
5,996,828 A * 12/1999 Cheyn ..... B65D 11/1873 220/4.31
6,089,394 A * 7/2000 Ziglar ..... D06F 95/002 220/6

(Continued)

FOREIGN PATENT DOCUMENTS

WO WO-8900531 A1 * 1/1989 ..... B65D 15/22

*Primary Examiner* — Mollie Impink
(74) *Attorney, Agent, or Firm* — Warner Norcross + Judd LLP

(57) ABSTRACT

An engineered handheld bin system constructed of modular components. The bins can be selectively assembled to maximize the number of components within the bins. The bins are transportable on a skid. The bin system includes a wall member, a base, four corner members, and a frame. The four corner members releasably and interlockably couple the frame to the base.

13 Claims, 12 Drawing Sheets

(56) References Cited

U.S. PATENT DOCUMENTS

| | | | | |
|---|---|---|---|---|
| 7,395,956 | B1 * | 7/2008 | Bell | G07C 13/02 220/4.33 |
| 8,261,922 | B2 * | 9/2012 | Jin | B65F 1/02 220/4.28 |
| 8,720,736 | B2 * | 5/2014 | Boland | B42F 15/007 220/617 |
| 2006/0175227 | A1 * | 8/2006 | Lau | B65D 15/22 206/600 |
| 2007/0221720 | A1 * | 9/2007 | Nyeboer | B65D 11/1893 229/199 |
| 2017/0233160 | A1 * | 8/2017 | Hudson | B44D 3/12 222/183 |

* cited by examiner

CONTAINER SYSTEM

CROSS-REFERENCE TO RELATED APPLICATIONS

This application claims the benefit of U.S. Provisional Application No. 62/333,510, filed on May 9, 2016. The entire disclosure of the above application is incorporated herein by reference.

FIELD

The present disclosure relates to bins for components and more particularly to bins which can be selectively assembled to maximize the number components within bins which are transportable on a skid.

BACKGROUND AND SUMMARY

This section provides background information related to the present disclosure which is not necessarily prior art.

Injection molded bins are designed to hold component or products for shipment and/or storage. One exemplary use is in the manufacturing industry. For example, the polymer bin may be reused many times for transporting component between a component supplier and an automobile or other product assembly plant.

Polymer bins have a finite usable life. When the polymer bin becomes damaged and is no longer useful, the bin is either discarded or ground up as a means of recycling the plastic. Alternatively, the polymer bin may become obsolete or unwanted if the component for which the bin is designed are discontinued and the polymer bin does not adequately fit another component.

Polymer bins are made in a limited number of sizes or footprints. The sizes are limited so they fit in a desired manner inside a standard pallet footprint for shipping purposes, which is commonly 48 inches by 45 inches. Polymer bins are made in a limited number of heights so that when loaded and stacked, the height of the pallet load is between 48 and 52 inches or close. For example, one common load is 11 inch tall polymer bins stacked four high. Polymer bin tooling is very expensive. In addition, making such tooling for tall polymer bins (say 23 inches) is difficult. For 48×45 pallet layouts 24"(l)×22"(w)=pallet layout 2×2(bins/layer)×(tbd) # layers; 24"(l)×15"(w)=pallet layout 2×3(bins/layer)×(tbd) # layers; 16"(l)×15(w)=pallet layout 3×3(bins/layer)×(tbd) # layers; 15"(l)×12"(w)=pallet layout 3×4(bins/layer)×(tbd) # layers The inside height of a 52' semi-trailer is 110". Therefore, comfortable max pallet load height is 52", but it could go up to 54.5" or could be one pallet load stack up to 109". It is very important that potential number of layers of bins per pallet is numerous. You also don't have to stack like bin heights on each pallet. This opens even more combinations. The main boundary is the pallet dimensions and truck dimensions. A pallet doesn't have to be a 48×45 size. Some bin sizes work on 36"×30" or 32"×30 or 38"×32".

What is needed in the art is a method of manufacturing a custom sized plastic bin from one or more unwanted, obsolete, or damaged polymer bins. The resulting bin is lighter and, therefore, cheaper and easier to transport than known cut and welded polymer bins.

Accordingly, further areas of applicability will become apparent from the description provided herein. The description and specific examples in this summary are intended for purposes of illustration only and are not intended to limit the scope of the present disclosure.

According to the present teaching, a selectively configurable bin is taught having a wall member formed of a corrugated material. The corrugated material is configured to plastically deform in compression around its perimeter. A monolithic base is formed of a rigid injection molded plastic. The base defines a frame and a web portion, the base frame has corner ribs configured to increase added impact strength. The web portion includes a circular rib in center configured to reduce deflection of the web. Defined within the base frame is a channel configured to capture a secure bin wall member in place.

Disposed within the channel, are a plurality of longitudinal and diagonal ribs configured to add rigidity. Protrusion features are formed lining inside of bin wall channel to pinch/secure the wall in place, the protrusion features protrude from the perimeter inset for nesting inside of bin top rim when vertically stacking multiple bins. Male locating post with a flexible clip feature lock corner post in position and unlocking for disassembly of bin.

The frame defines a flush exterior base wall configured to increase impact strength and a clean side by side stacking. A plurality of exterior vertical rib features are configured for lightweight impact and compression strength, the base frame includes molded handles on opposed first ends of base. Four corner bin members which are extruded can be cut to desired length. They can have 2 notches equally defined approximately 1" from the edge with the corner post height being adjustable to provide a bin with a predefined height efficiently. An interior of corner post defines a void to fit over the protruding male features in the corners of the base. Notches defined on opposite ends of the four corner members to accept rigid flexible clips on the base, wherein the notches have enough space to accept the male clip feature, securing the corner post to the base.

A monolithic frame formed of four members coupled members defining a through aperture is coupled to a second end of each of the four corner posts. Similar to the monolithic base, each of the four members of the monolithic frame define a wall member accepting slot, the slot has a plurality of ribs configured to engage and compress a portion of the periphery of the wall member.

According to the present teachings, a configurable bin has a wall member formed of a corrugated material, said corrugated material configured to plastically deform in compression around a perimeter of the wall member. The bin has a monolithic base formed of a rigid injection molded plastic, and a base frame and a web portion. Defined within the base frame is a channel configured to capture and secure the wall member perimeter, disposed within the channel, are a plurality of ribs configured to deform on of the four wall members, the ribs protruding a wall defining the channel, said monolithic base having four coupling corner members. Four corner members each defining a through aperture configured to engage one of the four coupling members. The bin contains a monolithic frame formed of four frame members and defining a wall member accepting slot, said slot having a plurality of ribs configured to engage and compress a portion of the periphery of the wall member.

BRIEF DESCRIPTION OF THE DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION OF THE FIGURES

Figure 1:
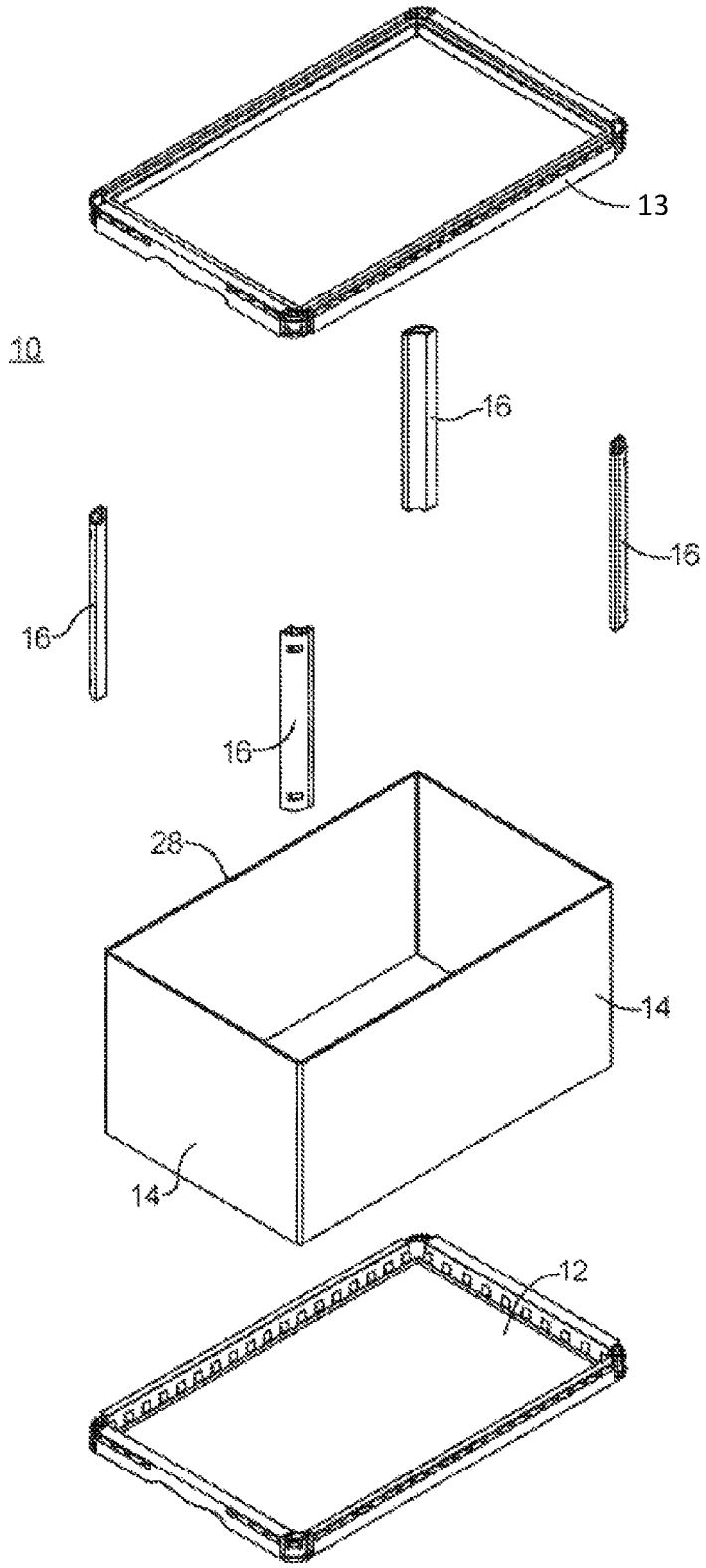
FIG. 1 represents an exploded view of the container system according to the present teachings.

FIG. 1 represents an exploded view of the container system 10 according to the present teachings. The container system 10 includes a base portion 12, a frame 13, side panels 14, and four corner members 16. By adjusting the length of the corner members 16 and height of the side panels, the assemblable container system 10 can have a selectable height.

Figure 2A:
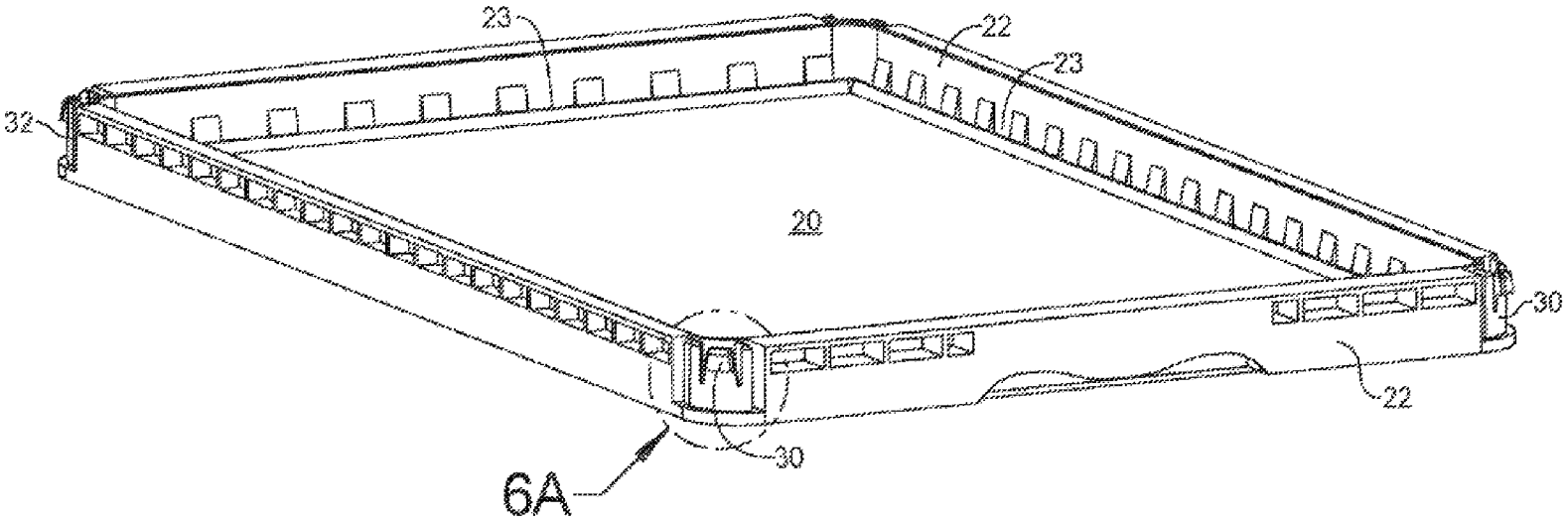
FIGS. 2*a*-2*c* represents a bottom component of the container system shown in FIG. 1.
Figure 2B:
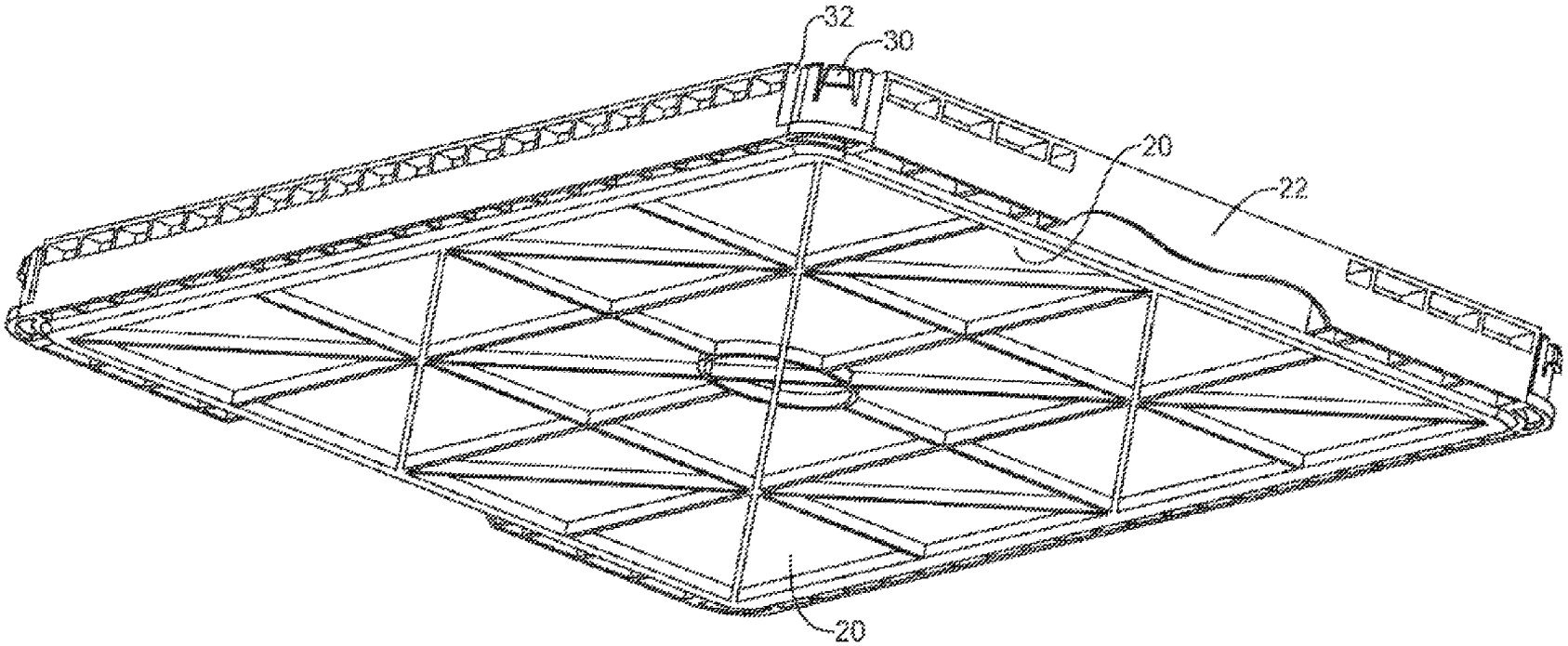
Figure 2C:
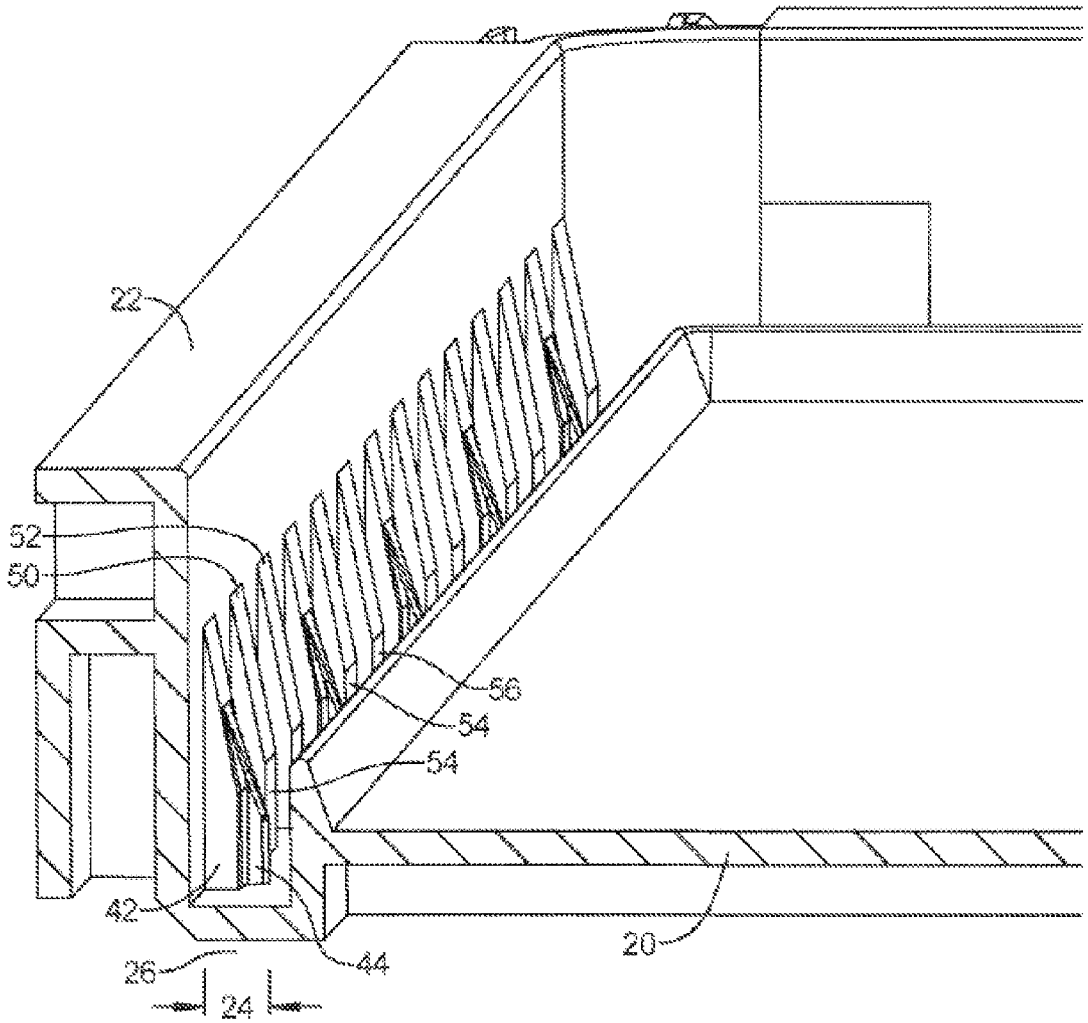
Figure 3A:
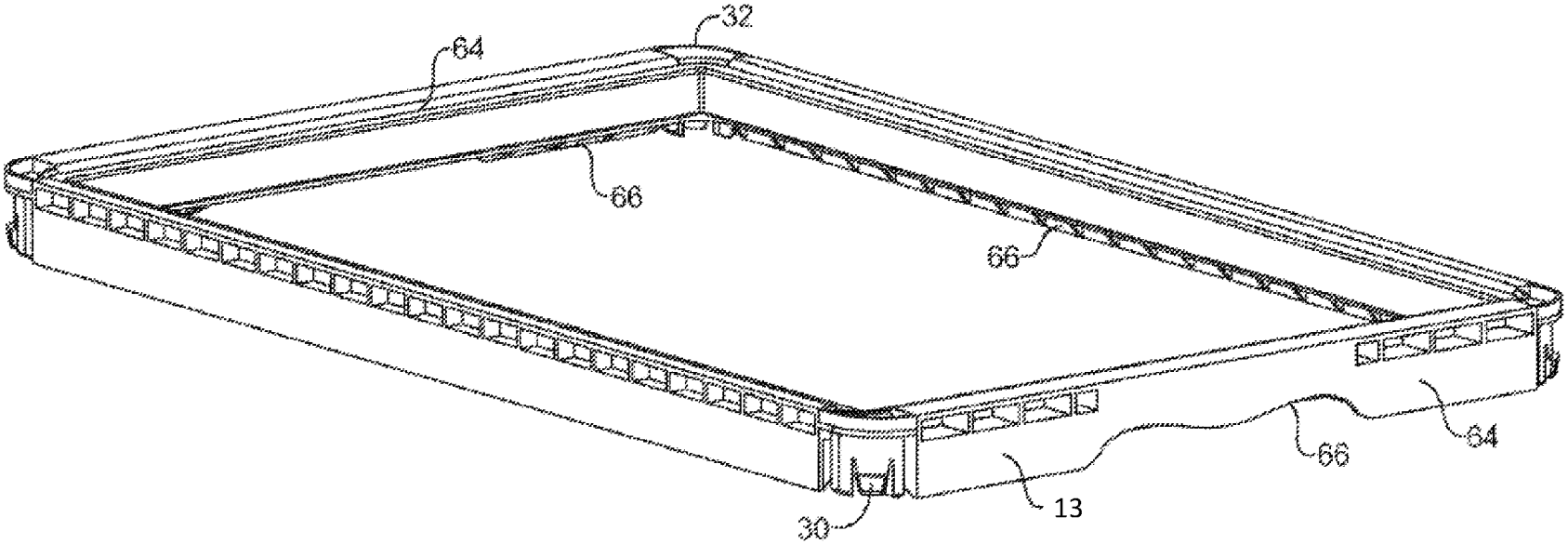
FIGS. 3*a*-3*d* represent a top frame component of the container system shown in FIG. 1.
Figure 3B:
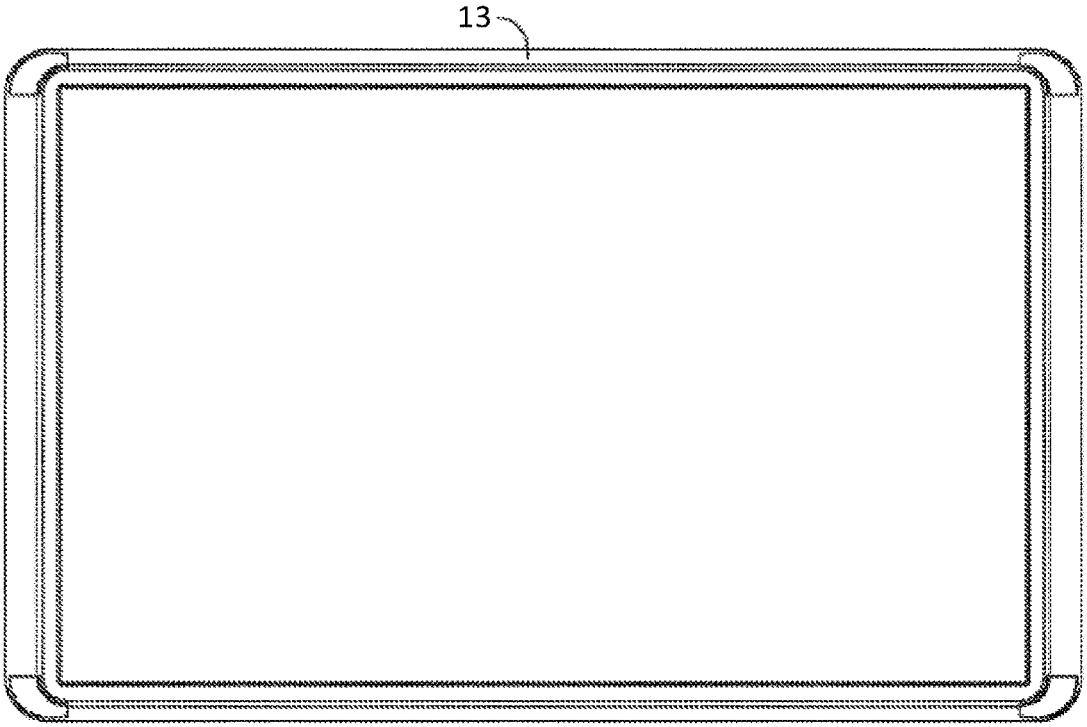
Figure 3C:
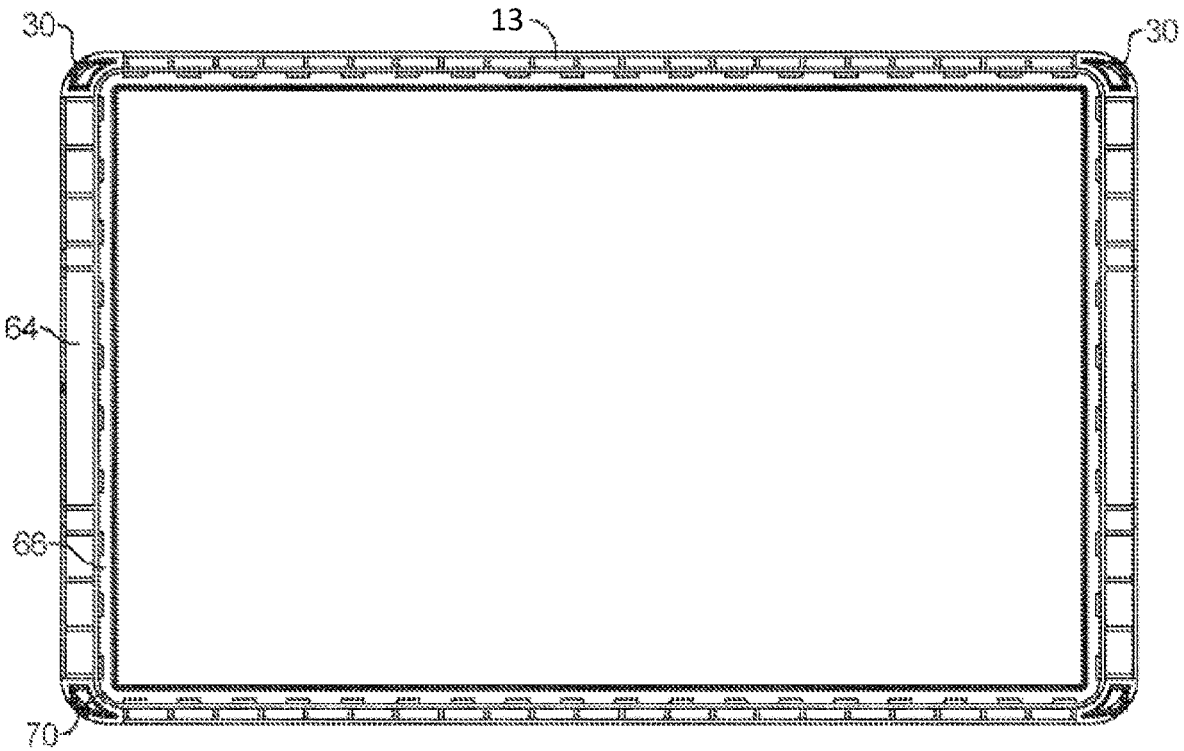
Figure 3D:
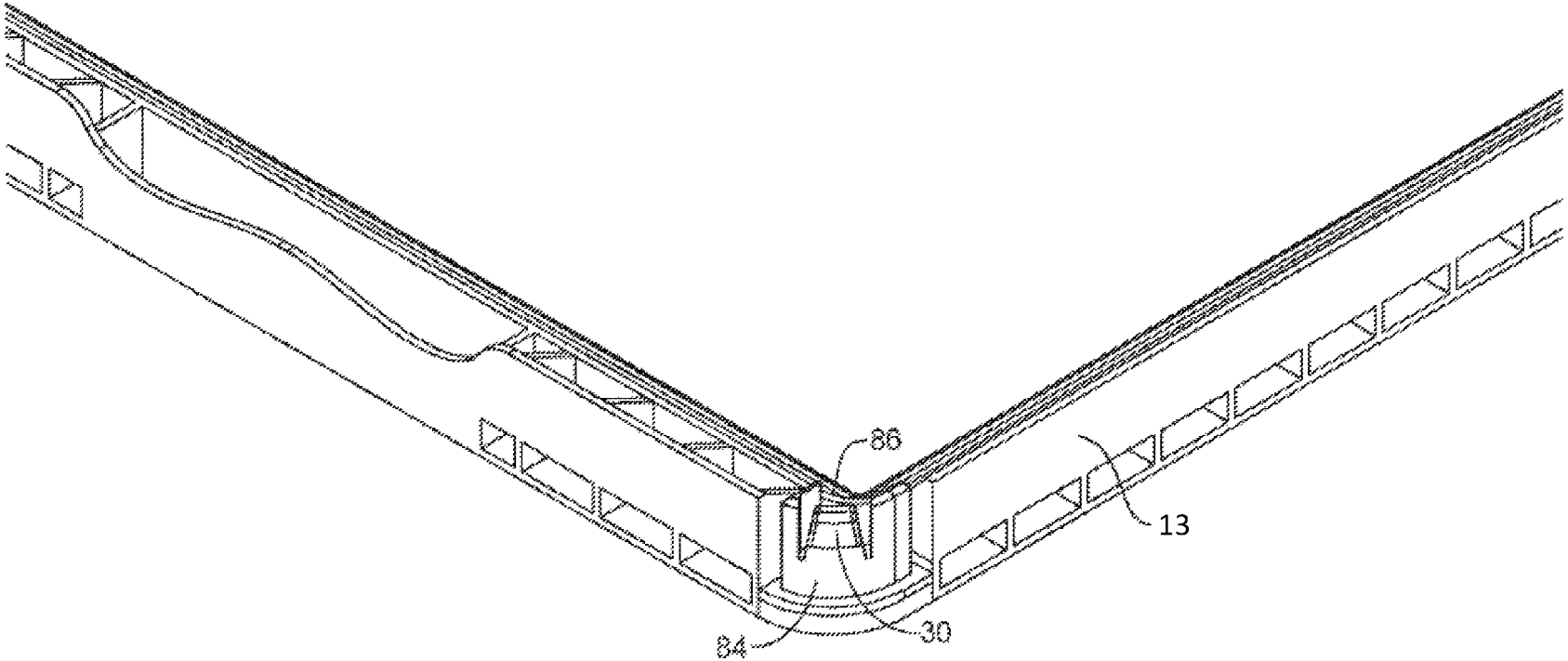

As shown in FIGS. 2*a*-2*c*, the base member 12 includes a solid planar member 20 surrounded by a first frame 22. Defined between the planar member 20 and the first frame 22 is a coupling slot 24 configured to selectively receive the side panel 14. In this regard, the slot 24 has a width 26 which is smaller than the thickness 28 of the side panel 14. Additionally shown are four corner coupling members 30 defined within an aperture 32 defined within the frame 22. As described later in detail the aperture 32 defines a surface 34 which bears upon an exterior bearing surface 36 defined on the ends of the corner members 16. As shown in FIG. 2*b*, the planar member 20 can have reinforcing ribs 40 which add to the stiffness. Likewise, the frame 22 of the base 12 can be hollow having reinforcing ribs 42.

As shown in FIG. 2*c*, the coupling slot 24 has a plurality of extended coupling flanges 42 and 44 which plastically deform the side panels 14. In this regard, the side panels 14 are plastically and elastically deformable. They can be for instance polymer corrugated layers having a pair of outside planar members separated by a corrugated polymer. Additionally, the side members can be compressible foam material disposed between a pair of films. Lastly, the corrugated material can be made of cardboard.

Generally, the flanges 42 and 44 are disposed on a single side of the channel. The flanges 42 and 44 have a first portion 50 which has a ramp or tapered surface 52 and a second portion 54 having a flat surface 56 which is parallel to the channel walls and perpendicular to the channel bottom 56. The flanges 42 and 44 each have bearing surfaces 58 and 60 which have different widths. Further, the second flange is disposed on the first flange 42 at intervals, for example every fourth flange.

FIGS. 3*a*-3*d* represent the top frame 13 which locks into the side panels 14 and the corner members 16. Similar to the base 12, the frame 13 has corner coupling members 30 disposed within an aperture. On a pair of side members 64 is a pair of concave surfaces 66 which define handle portions. The frame 13 further defines a coupling channel 67 which interfaces within the side panels 14 using an interference fit. Disposed within the channel are coupling ribs 68 which collapse the side wall materials.

Figure 4A:
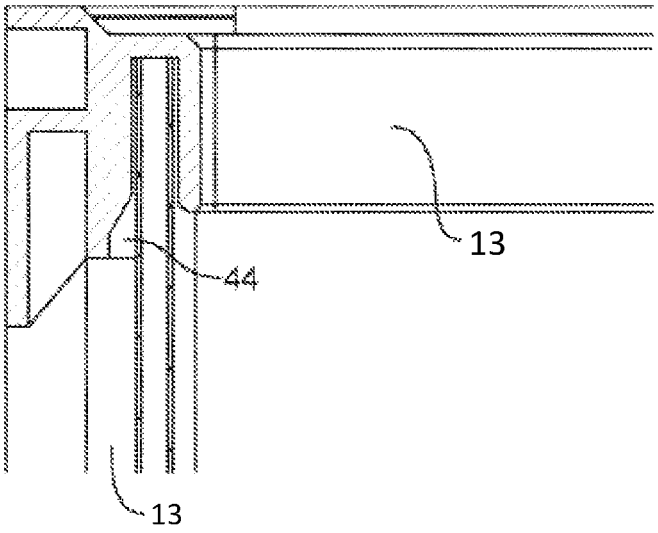
FIGS. 4*a*-4*b* represent the interaction of a side panel with the top frame and base respectively.
Figure 4B:
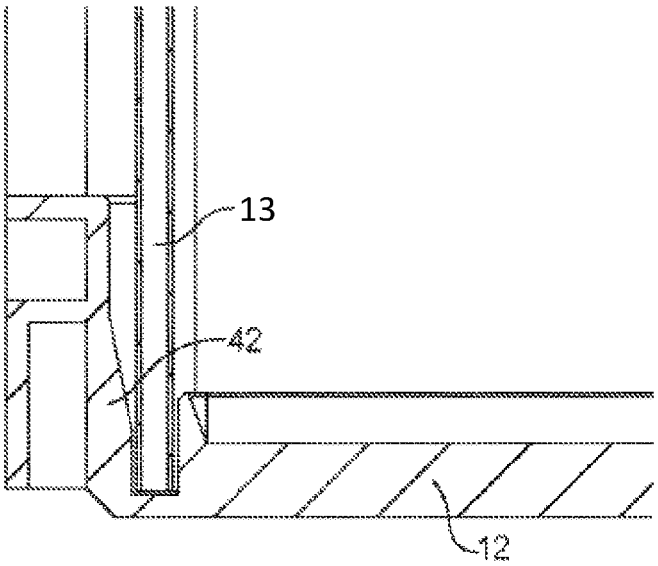
Figure 5A:
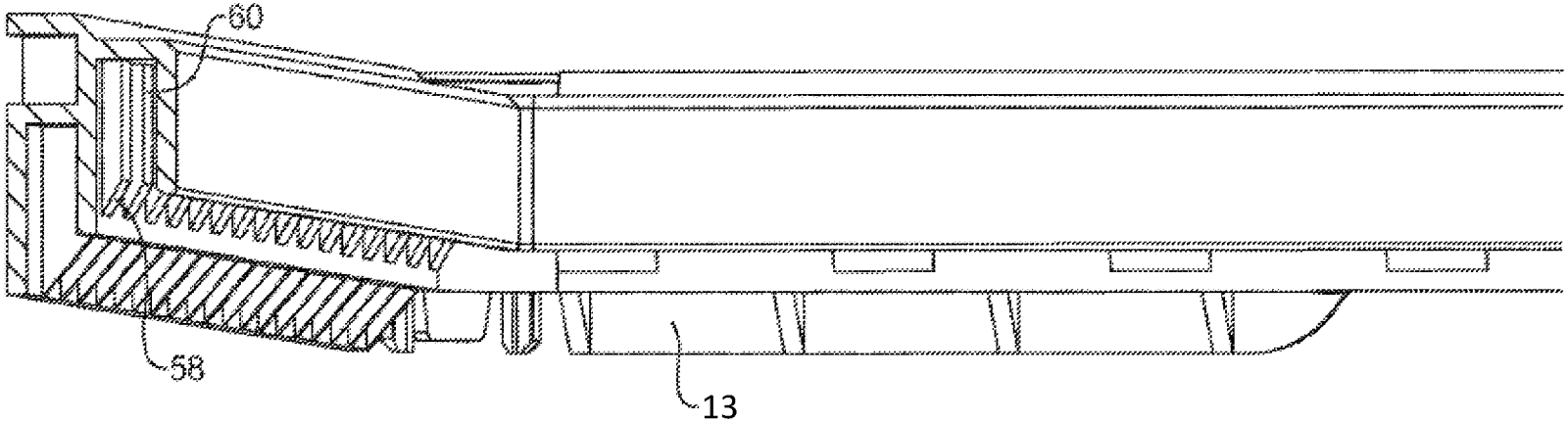
FIGS. 5*a* and 5*b* represent cross-sectional views of the frame shown in FIGS. 3*a*-3*d;*
Figure 5B:
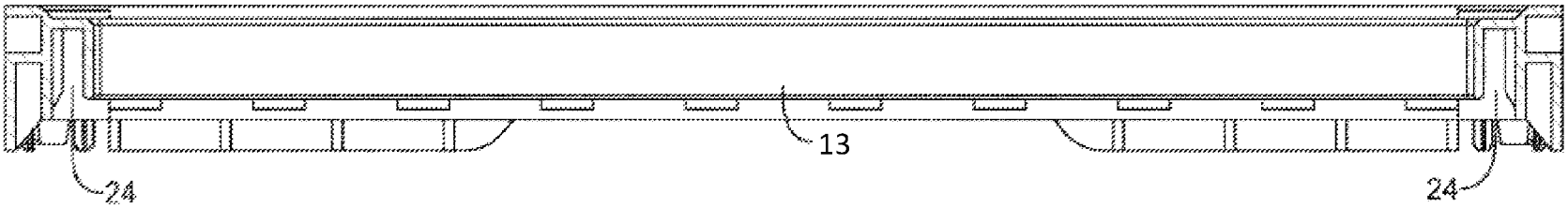

FIGS. 4*a* and 4*b* are cross sections of the bottom member 12 and the frame 13. Also shown is interference fit between the side member 16 and the flanges 42, 44 and 68. FIGS. 5*a* and 5*b* show the disposition of coupling flanges 68 and reinforcement flanges within the frame. Also shown is a corner wall 70 which is located adjacent to the corner coupling member 30.

Figure 6A:
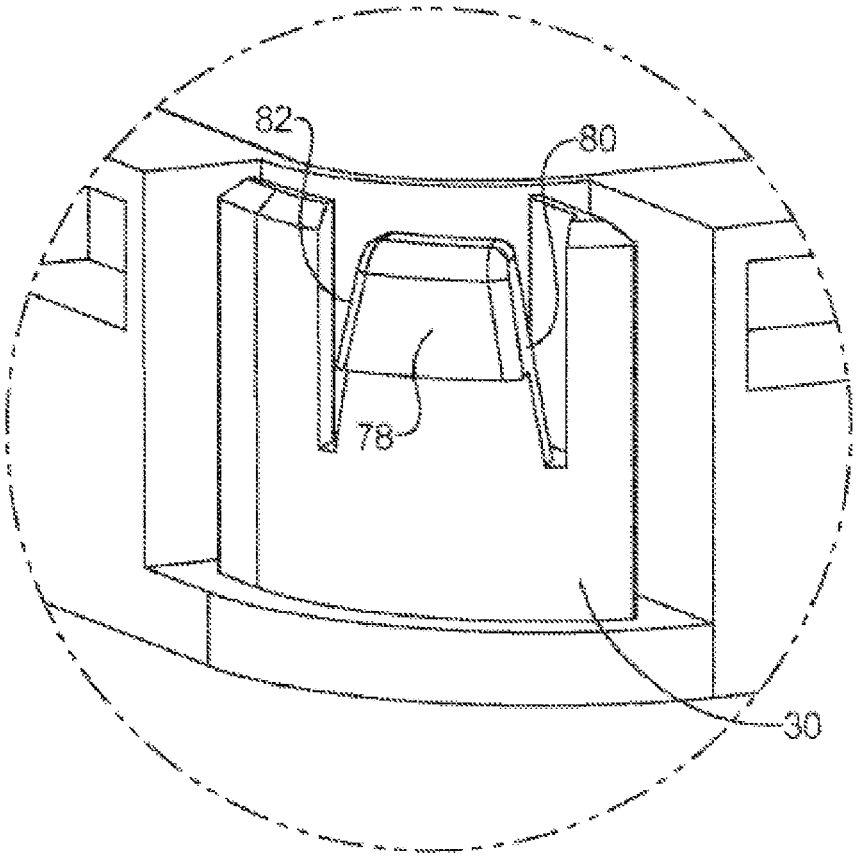
FIGS. 6*a* and 6*b* represent corner coupling members focused in the base and frame.
Figure 6B:
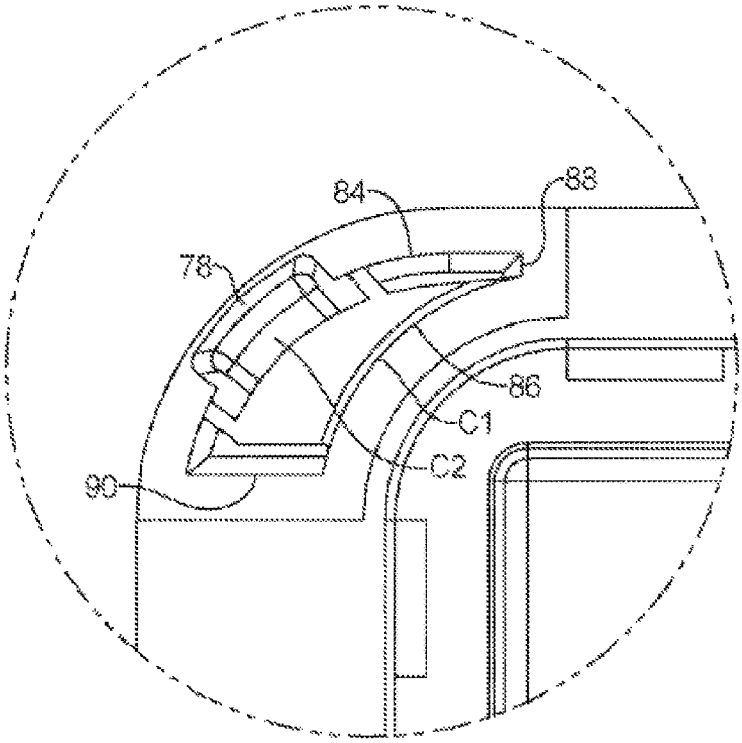

FIGS. 6*a* and 6*b* represent the corner coupling members 30 which are found in the corners of the base 12 and frame 13. The corner coupling member 30 has a latching member 76 which engages an aperture 81 defined in the corner members 16. The flange has first, second and third tapered surfaces 78, 80, 82 and a bearing surface 84 which couples to a bearing surface on the aperture 81 on the corner member 16.

Figure 7:
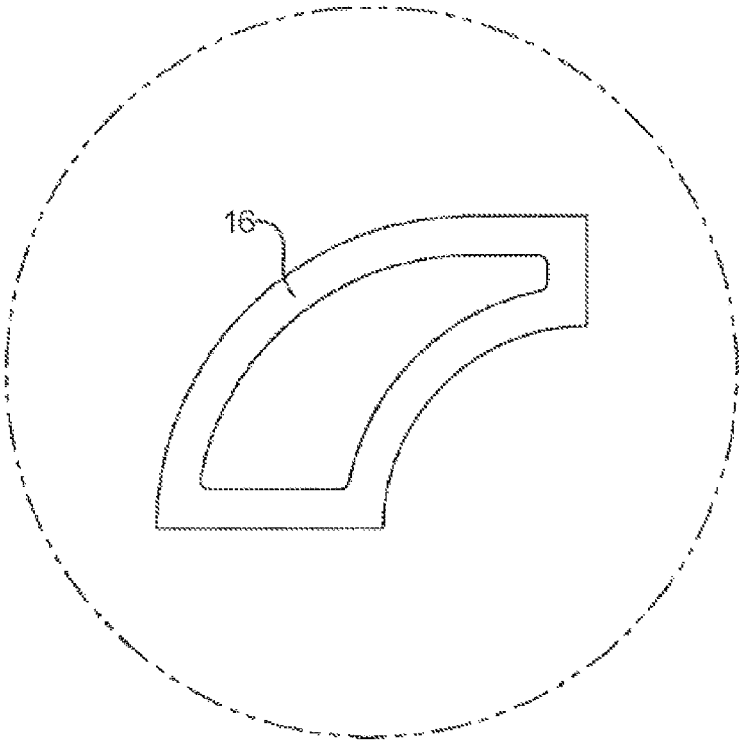
FIG. 7 represents a top view of the corner members shown in FIG. 1.

As best seen in FIG. 6*b*, the corner locking member 30 has a first curved exterior surface 84 and a second interior curved surface 86. The first and second curved surfaces 84 and 86 can have different radius $R_1$, and $R_2$ and can also have different curvatures $C_1$ $C_2$. Disposed between the first and second curved surfaces 84 and 86 are first and second ends 88 and 90 each having different lengths. This shape corresponds to an interior through cavity 94 having a complimentary cross section which allows the incorporation of the corner member 16 over the corner member 30. (See FIG. 7).

Example embodiments will now be described more fully with reference to the accompanying drawings. The configurable cargo elements have a monolithic base, four deformable wall members, four corner posts, and a rim member. The wall member is formed of a corrugated material configured to plastically deform when subjected to compression around its perimeter. A monolithic base formed of a rigid injection molded plastic.

The base has a base frame and a web portion, the base frame has corner ribs configured to increase added impact strength. The web portion can include a circular rib in center configured to reduce deflection of the web portion. Defined within the base frame is a channel configured to selectively capture and secure the bin wall/sleeve in place. Disposed within the channel, are a plurality of longitudinal and diagonal ribs configured to add rigidity, protrusion features are formed lining inside of bin wall channel to pinch/secure the wall in place. The protrusion features protrude from the perimeter inset for nesting inside of bin top rim when vertically stacking multiple bins. Male locating post are provided with flexible clip features for locking corner post in position and unlocking for disassembly of bin, the frame defines a flush exterior base wall configured to increase impact strength and a clean side by side stacking. A plurality of exterior vertical rib features are configured for lightweight impact and compression strength, the base frame includes molded handles on opposed first ends of base.

Each of the four corner bin members can be formed from one piece extrusion cut to desired length having 2 notches equally defined approximately 1" from the edge with the corner post height being adjustable to provide a bin with a predefined height efficiently. An Interior of corner post defines a void to fit over the protruding male features in the corners of the base. Notches defined on opposite ends of the four corner members to accept rigid flexible clips on the base, wherein the notches have enough space to accept the male clip feature, securing the corner post to the base.

A monolithic frame is formed of four members defining a through aperture, each of the four members defines a wall member accepting slot on a first side. The slot has a plurality of ribs configured to engage and compress a portion of the periphery of the wall member.

The rigid injection molded plastic single piece top rim can be formed of polypropylene or comparable material. The formed perimeter channel is configured to capture and secure bin wall/sleeve in place. Formed protrusion features lining inside of top rim sleeve channel to pinch & secure sleeve in place. Full perimeter indentation inside top rim that accepts base protrusion when stacking vertically. Flush exterior top rim wall is provided for impact strength and clean side by side stacking. Exterior vertical rib features for lightweight impact and compression strength. Male locating post with flexible clip feature for locking corner post in position and unlocking for disassembly of bin Molded handles on width ends of top rim allowing bin to be picked up by the top rim in an ergonomically supportive position.

As described about male and female features are defined within the device for nesting inside of bin top rim when vertically stacking multiple bins. Male locating post with flexible clip feature for locking corner post in position and unlocking for disassembly of bin. Flush exterior base wall are configured for impact strength and clean side by side stacking. Exterior vertical rib features for lightweight impact and compression strength. Molded handles on wide ends of base allowing bin to be picked up by the base in an ergonomically supportive position.

The corner support members can be formed of Polypropylene which resists cracks, dents and deformation or destruction in extreme temperatures. The lightweight design created by pocketing or removing material from the side walls and bottom structure while retaining overall rigidity. Ribbing on sidewalls, base, and interior to reduce deflection and increase rigidity. Base ribbing reduces friction for line automation and prevents deflection when put under a force. Channels are defined into the corner members to capture and securely hold a sleeve in place on two opposite sides of the wall member. Pinch points that apply pressure on the sleeve to help hold in place against the wall with friction. Channel and pinch points prevent sleeve side wall from collapsing inward during a side impact.

Channel should to capture around ¼" to 1" of the sleeve, in this example it captures approximately ½" of the sleeve. Protruding male features in corners to aid in locating corner supports is drafted or angled to help lead the corner post into position prior to locking in place with the clip feature Corner feature perimeter matches the inside of the corner post void to provide support when engaged. Once engaged this feature also provides strength between the base, lid and corner posts when under a sideways load or stress by preventing corner posts from moving. Rigid flexible clips secure the corner supports in place: a. Clips flex under enough force to allow for disengagement and disassembly of container for flat shipment and efficient storage.

The corner post can be engaged onto the securing clip with ⅛ to ½ of the force it takes to disengage the corner post from its locked position. Ideally in this example it requires ¼ of the force to engage the corner post than to remove it. Molded handles allowing for bin to be picked up by the base in an ergonomically supportive position. Existing bins only have handles around the top perimeter and require the user to carry the load below their hands; and b. Handles on the base allow for the user to hold the bin near their chest, above their hands and an ergonomic position. Base protrusion feature that nest inside top rim feature for vertical stacking of multiple bins including those of different manufacturers.

Multiple Length×Width footprints (ex 24×15, 12×15×22×20, etc.) covering common pallet, truck, container and rail car dimensions are possible. The top or upper frame, is similar to base in construction in as much as it is an Injection molded PP or comparable material. The upper frame has a ribbing on sidewalls, base, and interior to reduce deflection and increase rigidity. It further defines a channel to capture and securely hold sleeve in place on all 4 sides including the a. Channel on base and top rim work in harmony with the locking extruded corner posts to secure the sleeve in position. The channel has protruding injection mold features that pinch/compress sleeve to further assist in securing sleeve in place.

Male features in corners to aid in locating supports in place. In this regard, rigid flexible clips secure the supports in place. The clips flex under enough force to allow for reuse. Molded handles allow for bin to be picked up by the base. Full perimeter indentation is formed inside of the top rim accepts base protrusion for vertical stacking. The bin stacking features work together with other bin manufacturers of similar footprint. Flush exterior wall for impact strength and clean side by side stacking with other bins.

Corner bin members are one piece extrusion cut to desired length with 2 notches equally cut approximately 1" from the edge. By customizing a corner post height the finished bin to efficiently optimize a desired pallet load by eliminating void space typically associated with existing static height bins. The Interior of corner post has a designed void to fit over the protruding male features in the corners of the base and top rim. Notches cut on opposite ends to accept rigid flexible clips on the base and top rim a. notches have enough space to accept the male clip feature, securing the corner post to the base or top rim.

Optionally, one piece extrusion cut to desired length to create a custom height. The corner blocks assembled together to create desired height. Telescoping posts that can be adjusted and locked into a desired height. No corners sleeve only securely held by rim and base sides. Sleeve made of rigid plastic corrugated or alternative 3 ply materials with vertical stacking and side impact strength. Sleeve is cut to size allowing the bin to be custom in its height and providing additional support to the corner posts under stress securely fitting inside the base and top rim rail. Sleeve is glued or butt welded for additional side impact strength. Can be printed with customer graphics, component diagrams and/or instructions Existing bins can only be hot stamped or need additional labeling corresponding reference numerals indicate corresponding component throughout the several views of the drawings.

The inside height of a 52' semi-trailer is 110". A comfortable max pallet load height is 52", but it could go up to 54.5" or could be one pallet load stack up to 109". The system provides totes that allow for the maximum that potential number of layers of bins per pallet. Furthermore, the system allows for multiple height totes to be provided on a single pallet. The main boundary is the pallet dimensions and truck dimensions. A pallet doesn't have to be 48×45. Some bin sizes work on 36"×30" or 32"×30 or 38"×32" . . . etc.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing component in particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the component in particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without decomponenting from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements or features of a componenticular embodiment are generally not limited to that componenticular embodiment, but, where applicable, are interchangeable and can be used in a selected embodiment, even if not specifically shown or described. The same may also be varied in many ways. Such variations are not to be regarded as a decomponenture from the disclosure, and all such modifications are intended to be included within the scope of the disclosure.

What is claimed is:

1. A modular, readily adjustable bin comprising:

a wall member;

a base having a base frame and a web portion, defined within the base frame is a channel configured to capture the wall member, said base having a first four coupling corner members;

four corner members each defining a first through aperture configured to mechanically interlock in a readily releasable manner with one of the first four coupling members; and a frame defining a wall member accepting slot and having a second four coupling corner members;

wherein the four corner members each define a second through aperture configured to mechanically interlock in a readily releasable manner with one of the second four coupling corner members;

wherein the wall member is formed from a sheet material, the sheet material having a plurality of fold lines, each fold line forming a corner joining adjacent side panels;

wherein the corner members are disposed outwardly from the corners; and wherein the wall member accepting slot, and the channel configured to capture the wall member each comprise a plurality of ribs configured to accept and compress the wall member.

2. The modular, readily adjustable bin of claim 1, wherein the base is formed of a rigid injection-molded plastic comprising polyethylene or polypropylene.

3. The modular, readily adjustable bin of claim 1, wherein the corner members are readily released from one of the first four coupling corner members or from one of the second four coupling members by depressing a flexible clip.

4. The modular, readily adjustable bin of claim 1, wherein a height or an interior volume of the modular, readily adjustable bin may be adjusted by replacing a first four corner members having a first length with a second four corner members having a second length and by replacing a first wall member having a first height with a second wall member having a second height.

5. A modular, readily adjustable bin comprising:

a wall member;

a base having a base frame and a web portion, defined within the base frame is a channel configured to capture the wall member, said base having a first four coupling corner members;

four corner members each defining a first through aperture configured to mechanically interlock in a readily releasable manner with one of the first four coupling members; and a frame defining a wall member accepting slot and having a second four coupling corner members;

wherein the four corner members each define a second through aperture configured to mechanically interlock in a readily releasable manner with one of the second four coupling corner members;

wherein the wall member is formed from a sheet material, the sheet material having a plurality of fold lines, each fold line forming a corner joining adjacent side panels;

wherein the corner members are disposed outwardly from the corners;

wherein the base defines four corner apertures for receiving each of the first four coupling corner members respectively; and wherein each of the first four coupling corner members includes a first exterior curved surface having a first radius of curvature and a second internal curved surface having a second radius of curvature different than the first radius of curvature.

6. A modular, readily adjustable bin comprising:

a wall member;

a base having a base frame and a web portion, defined within the base frame is a channel configured to capture the wall member, said base having a first four coupling corner members;

four corner members each defining a first through aperture configured to mechanically interlock in a readily releasable manner with one of the first four coupling members; and a frame defining a wall member accepting slot and having a second four coupling corner members;

wherein the four corner members each define a second through aperture configured to mechanically interlock in a readily releasable manner with one of the second four coupling corner members;

wherein the wall member is formed from a sheet material, the sheet material having a plurality of fold lines, each fold line forming a corner joining adjacent side panels;

wherein the corner members are disposed outwardly from the corners;

wherein each of the first four coupling corner members includes a first exterior curved surface having a first radius of curvature and a second internal curved surface having a second radius of curvature different than the first radius of curvature; and wherein each of the first four coupling corner members includes a first end surface having a first length and a second end surface having a second length different than the first length.

7. A modular, readily adjustable bin comprising:

a wall member formed of a sheet;

a base including a channel configured to receive an edge of the wall member, said base having a first four coupling corner members;

four corner members each defining a first through aperture configured to mechanically interlock in a readily releasable manner with one of the first four coupling corner members;

a frame defining a wall member accepting slot and having a second four coupling corner members;

wherein the corner members each define a second through aperture configured to mechanically interlock in a readily releasable manner with one of the second four coupling corner members;

wherein the corner members are readily released from interlocked engagement with one of the first four coupling corner members or from one of the second four coupling corner members by depressing a flexible clip;

wherein the channel is disposed inwardly of the first four coupling members and the accepting slot is disposed inwardly of the second four coupling corner members;

wherein a length of the corner members is selected so that when the corner members interlockably couple the frame to the base, a first edge of the wall member is disposed within the accepting slot and a second edge of the wall member opposite the first edge is disposed within the channel; and wherein the base defines four corner apertures for receiving each of the first four coupling corner members respectively.

8. The modular, readily adjustable bin of claim 7, wherein the wall member is formed of a material selected from the group consisting of corrugated polymer, corrugated paper, and deformable foam.

9. The modular, readily adjustable bin of claim 7, wherein the base and frame are formed of polyethylene or polypropylene.

10. The modular, readily adjustable bin of claim 7, wherein the channel and the wall member accepting slot each comprise a plurality of ribs configured to accept and compress a portion of the wall member.

11. The modular, readily adjustable bin of claim 7, wherein the first four coupling corner members each define a first exterior curved surface having a first radius of curvature and a second internal curved surface having a second radius of curvature different than the first radius of curvature.

12. The modular, readily adjustable bin of claim 11, wherein each of the first four coupling corner members includes a first end surface having a first length and a second end surface having a second length different than the first length.

13. A modular, readily adjustable bin comprising:

a wall member;

a base having a base frame and a web portion, defined within the base frame is a channel configured to capture the wall member, said base having a first four coupling corner members;

four corner members each defining a first through aperture configured to mechanically interlock in a readily releasable manner with one of the first four coupling members; and a frame defining a wall member accepting slot and having a second four coupling corner members;

wherein the four corner members each define a second through aperture configured to mechanically interlock in a readily releasable manner with one of the second four coupling corner members;

wherein the wall member is formed from a sheet material, the sheet material having a plurality of fold lines, each fold line forming a corner joining adjacent side panels;

wherein the corner members are disposed outwardly from the corners; and wherein the four corner members are formed from one-piece extrusion and include an internal cavity running along an axis thereof and defining a space continuous with the first through aperture and the second through aperture.

* * * * *